United States Patent [19]

Komatsu et al.

[11] 4,159,771

[45] Jul. 3, 1979

[54] CONTAINER HAVING MULTIPLE INDEPENDENTLY UNSEALABLE COMPARTMENTS

[75] Inventors: Kenji Komatsu, Mitaka; Teruyoshi Wakamatsu, Chofu, both of Japan

[73] Assignees: Meiji Seika Kabushiki Kaisha; Dai Nippon Insatsu Kabushiki Kaisha, both of Tokyo, Japan

[21] Appl. No.: 853,847

[22] Filed: Nov. 22, 1977

[51] Int. Cl.[2] ..... B65D 11/22; B65D 17/24

[52] U.S. Cl. ..... 206/620; 206/532; 206/469; 206/608; 206/615; 206/625; 206/824

[58] Field of Search ..... 206/531, 532, 539, 469, 206/484, 467, 486, 824, 608, 609, 615, 620, 628, 611, 625

[56] References Cited

U.S. PATENT DOCUMENTS

| | | | |
|---|---|---|---|
| 2,255,331 | 9/1941 | Pospisil | 206/532 |
| 2,892,538 | 6/1959 | Middleton, Jr. et al. | 206/469 |
| 3,078,986 | 2/1963 | Ushkow | 206/484 |
| 3,357,631 | 12/1967 | Aid et al. | 206/609 |
| 3,394,869 | 7/1968 | Fontana et al. | 206/628 |
| 3,620,438 | 11/1971 | Wood et al. | 206/620 |
| 3,630,346 | 12/1971 | Burnside | 206/539 |
| 3,659,706 | 5/1972 | Serrell | 206/539 |
| 3,780,856 | 12/1973 | Braverman | 206/539 |
| 3,941,248 | 3/1976 | Moser et al. | 206/484 |

FOREIGN PATENT DOCUMENTS

| | | | |
|---|---|---|---|
| 1073786 | 6/1967 | United Kingdom | 206/484 |

*Primary Examiner*—Herbert F. Ross
*Attorney, Agent, or Firm*—Koda and Androlia

[57] ABSTRACT

A container comprises a plurality of interconnected compartments having rim flanges therearound and being individually sealed by a lid sheet attached to the rim flanges after portions of a product have been placed in respective compartments, the lid sheet being provided with edge slits and the rim flanges being provided with cutout notches which facilitate the prying and lifting of a corner portion of lid sheet and tearing off of a part thereof to unseal and open only a selected one of the compartments without disturbing the other compartments. This container in a preferred embodiment of the invention is housed in an outer box which can be easily opened to expose only parts of the container for selective unsealing of the compartments as stated above, and which can be easily reclosed for further storing of any remaining portions of the product.

4 Claims, 19 Drawing Figures

CONTAINER HAVING MULTIPLE INDEPENDENTLY UNSEALABLE COMPARTMENTS

BACKGROUND OF THE INVENTION

This invention relates generally to container structures made of sheet material, such as paper, cardboard, and synthetic resin sheet, for packaging purposes. More particularly, the invention relates to a container structure of this character comprising a plurality of independent, sealed compartments in integrally interlinked state each of which can be individually opened and unsealed independently of the other compartments and to a combination of this container structure with an outer box.

Containers of like character heretofore used for packaging purposes, in general, have been sealed by a cover or lid, which, upon being removed for opening, unsealed the entire container, thereby causing all of the accommodated goods to be exposed. For this reason, these known containers have been unsuitable for containing products which readily absorb moisture, products which easily oxidize, the products which undergo changes in characteristics or deteriorate when exposed to air, particularly in cases where these products are not used at once immediately after unsealing of the container but are consumed over a relatively long time.

In view of this problem, some products of the above mentioned nature have heretofore been packaged in independent bags, which in a plural number are accommodated in an outer package such as a box. After the outer package has been opened, each of these bags can be opened independently of the other bags. In most instances, however, since bags are made of flexible materials, they lose much of their function as convenient containers with easy access to their interiors once they are opened. This feature may render such bags inconvenient in the cases where the packaged product is a granular article or a product such as candy or biscuits, and it is desired to keep this product in the package container until it is completely consumed. In such cases, individual compartments with relatively stiff walls with openable upper lids may be more convenient for easy access to the product.

SUMMARY OF THE INVENTION

It is an object of this invention to solve the above described problems by providing a container comprising a plurality of mutually independent, sealed compartments in integrally interlinked state each of which can be individual opened independently of the other compartments, which can be left in their sealed state.

Another object of the invention is to provide a container as stated above in which each of the compartments can be easily unsealed and opened by finger-tip tearing action.

Still another object of the invention is to provide a container of the above described character in which the mutually independent compartments are of substantially box-like shape with relatively stiff walls, whereby the contents of these compartments can be easily taken out.

A further object of the invention is to provide a container as described above in combination with an outer box which can be easily opened to reveal only parts of the container to be opened, the container being held at its side ends to facilitate unsealing and opening of a selected compartment, and which can be easily and neatly reclosed to protect and store till unopened compartments and left-over portions of the product in an opened compartment, if any.

According to this invention in one aspect thereof, briefly summarized, there is provided a container comprising a container main structure having a plurality of hollow receptacles for containing portions of a product or products in sealed state, adjacent receptacles being integrally connected at their adjacent rims by a common connective rim flange, other outer rims of the receptacles having outer rim flanges and a lid sheet sealingly attached to the connective rim flanges and the outer rim flanges thereby to seal the interiors of the receptacles and thereby to form individually sealed compartments, the lid sheet having tear-facilitating means at edge parts thereof by which the lid sheet can be partially torn off to unseal and open any of the sealed compartments for extraction of the contained product without unsealing the other remaining compartments.

According to this invention in another aspect thereof, briefly summarized, there is provided a container of the above described character which is combined with and packaged in an outer box having a lid of flap type which can be easily opened to expose only portions of the lid sheet for partial tearing off thereof for unsealing and opening of selected components and extraction of portions of the product without dislodgement of the container out of the outer box, the lid being reclosable to further protect the container and any remaining contained product.

The nature, utility, and further features of this invention will be more clearly apparent from the following detailed description with respect to a preferred embodiment of the invention and modifications thereof when read in conjunction with the accompanying drawings in which like parts are designated by like reference numerals and characters.

Figure 10:
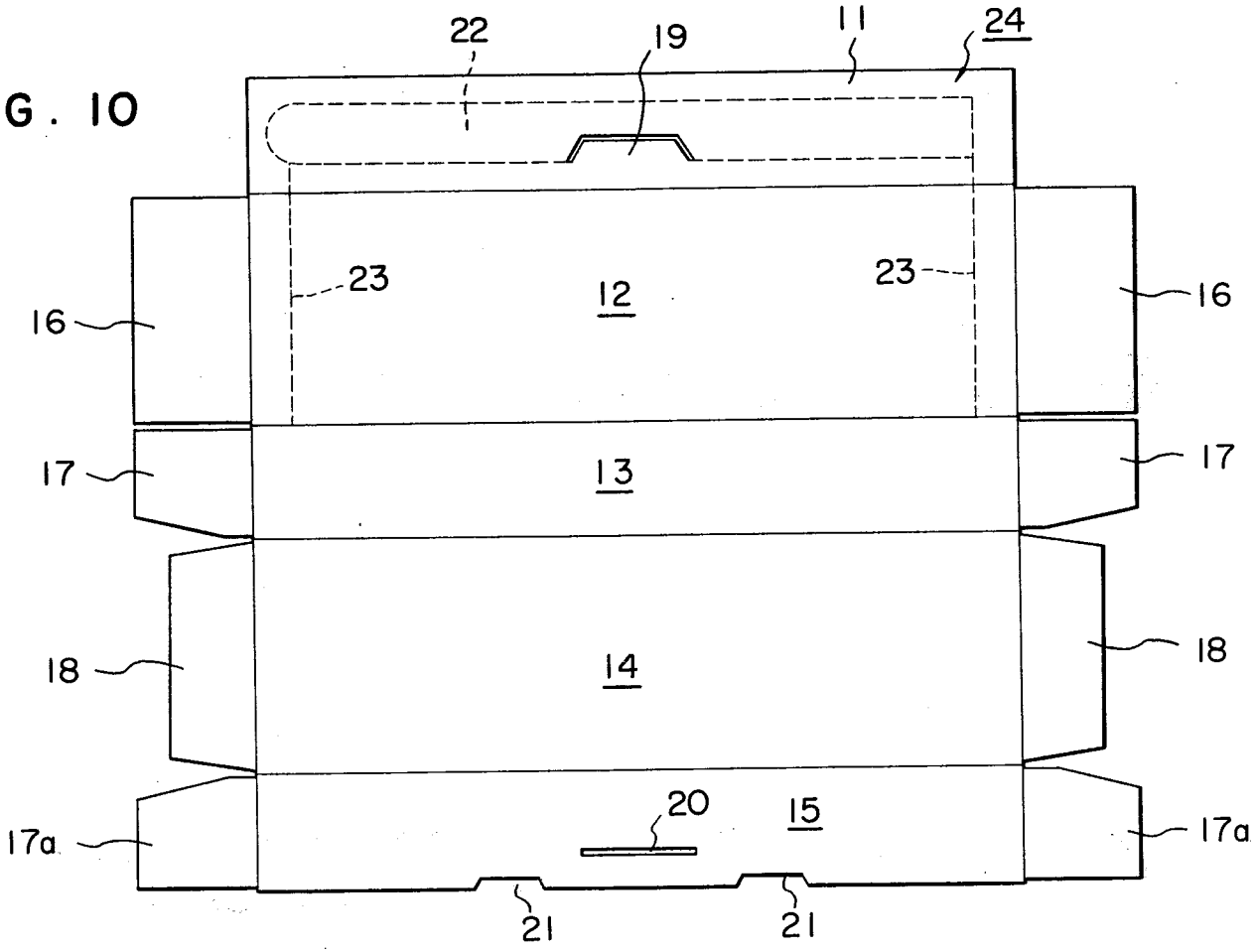
Figure 15:
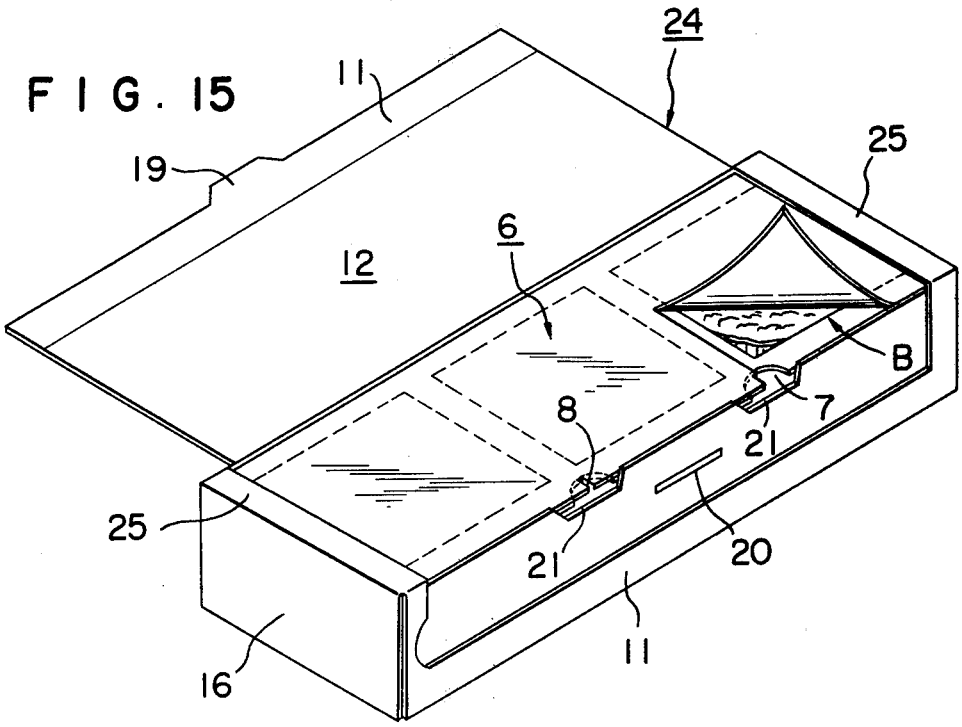
Figure 16:
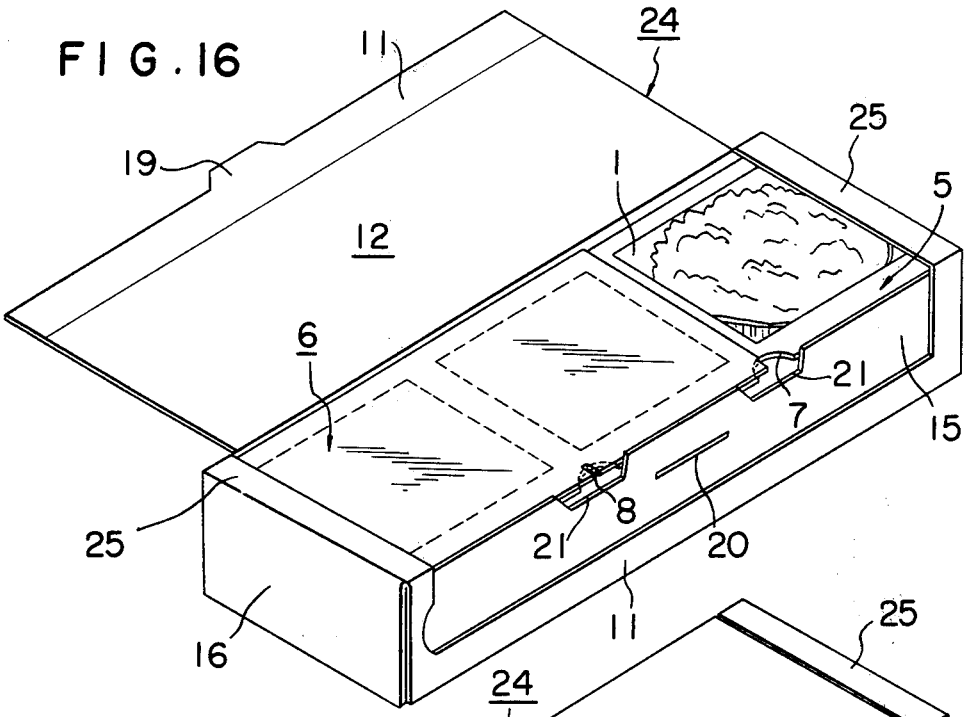
Figure 17:
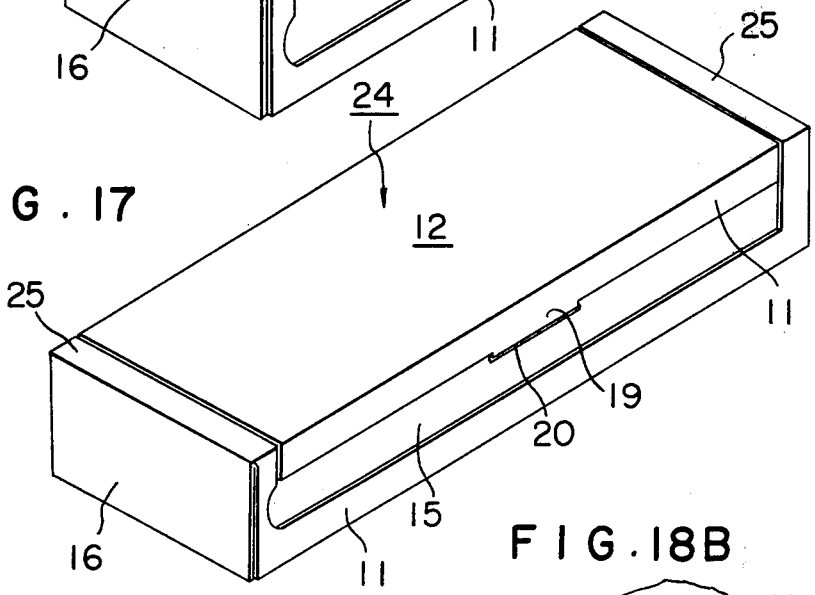
Figure 18A:
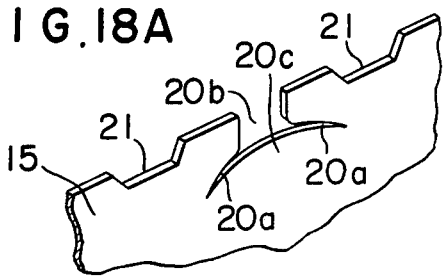
Figure 18B:
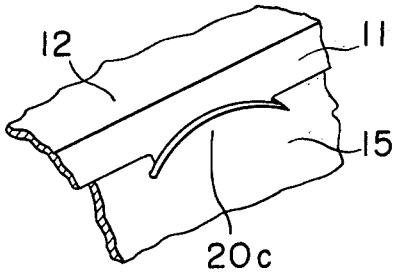

RIGS. 7, 8 and 9 are perspective views of further modifications of the container;

FIG. 10 is a planar view showing the development of a precut sheet of cardboard for forming an outer box;

FIGS. 11 through 17 are perspective views for a description of the use of the outer box; and FIGS. 18A and 18B are respectively a fragmentary planar view corresponding to the lower middle part of FIG. 10 and a fragmentary perspective view corresponding to the front middle part of FIG. 17 showing a modified shape of the slit to receive a tab when the lid of the outer box is closed.

DETAILED DESCRIPTION

Figure 1:
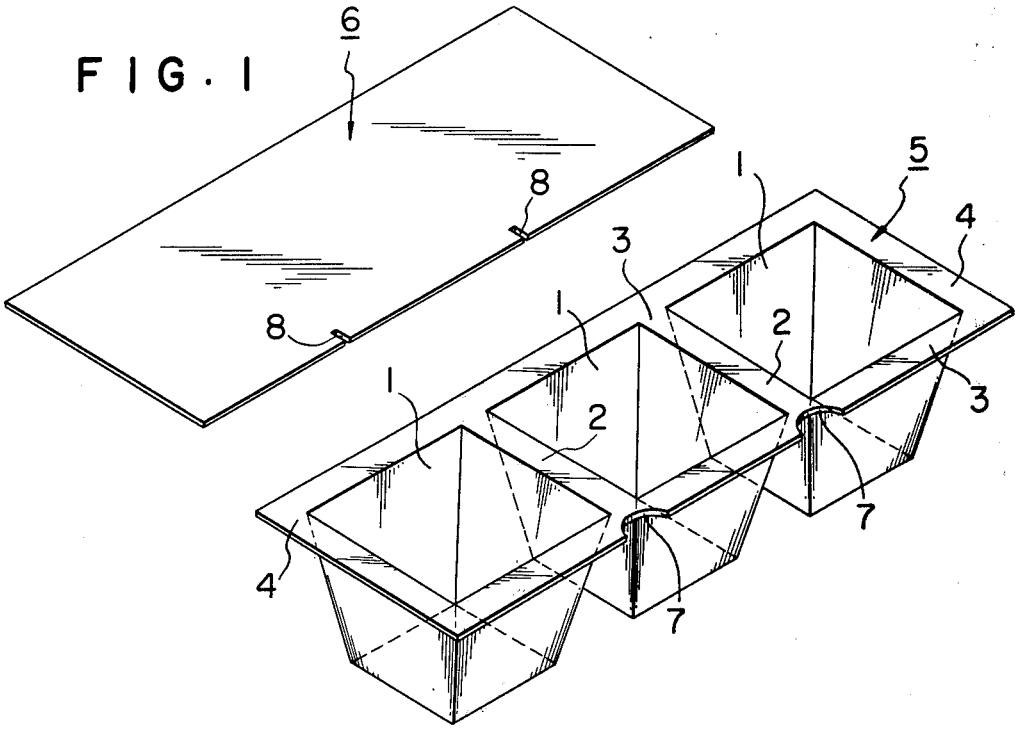
FIG. 1 is an exploded perspective view showing one example of a container according to this invention.

Referring to FIG. 1, the main structure 5 of the example of the container according to this invention shown therein is formed from a sheet of a synthetic resin by vacuum molding to have a shape as shown wherein a plurality of concavities or hollow receptacles 1 are formed in a row and interconnected by connective rim flanges 2. These receptacles 1, which are to become container compartments upon being closed and sealed by a lid sheet 6, have a common longitudinal rim flange 3 along each of their front and rear sides. The receptacles at the ends of the row have respective side end rim flanges 4 along their end peripheral parts. The front longitudinal rim flange 3 is provided at its outer edge at its juncture with the connective rim flanges 2 with semicircular notches 7.

The lid sheet 6 is made of a uniaxially-stretched, polyethylene film and is adapted to be placed flush against all of the flanges 2, 3, and 4 of the container main structure 5 for sealing as described hereinbelow. This lid sheet 6 is provided with slits 8 at its edge at positions corresponding respectively to the centers of the notches 7.

Figure 2:
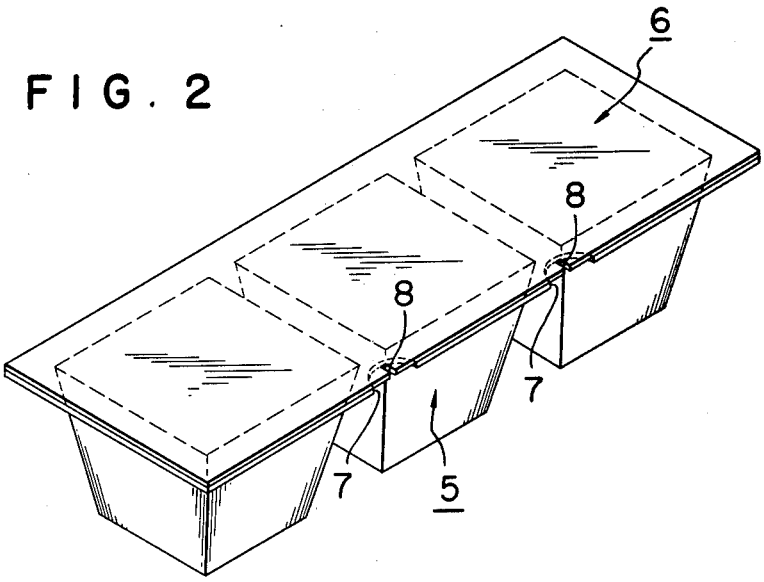
FIGS. 2, 3, and 4 are perspective views for a description of the opening and unsealing of a single compartment of the container independently of the other compartments.

For sealing the container of this invention after a product to be packaged has been placed in the receptacles 1 of the container main structure 5, the lid sheet 6 is placed on the upper flange surface of the main structure 5 as shown in FIG. 2 so that the slits 8 register with the corresponding notches 7, and the lower surface of the lid sheet 6 is sealingly attached to the upper surfaces of the front and rear, side end, and connective rim flanges 3, 4, and 2 by a method such as adhesive bonding or heat sealing. Thus, the receptacles 1 are rendered into sealed compartments containing the product.

Figure 3:
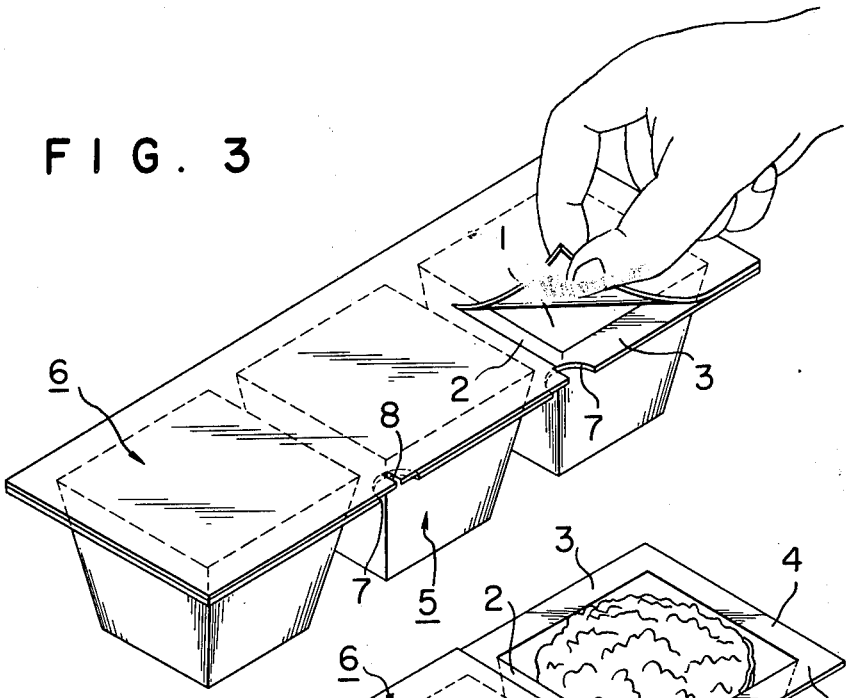
Figure 4:
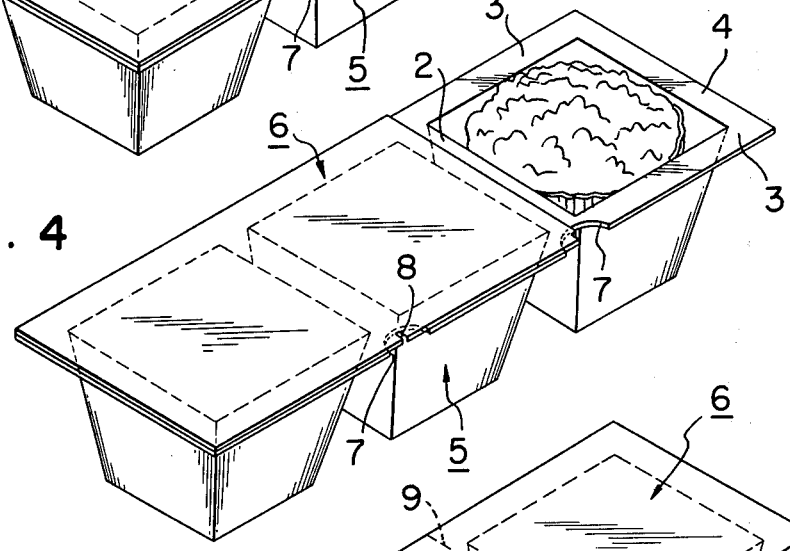

When one of the compartments of this container is to be opened, a finger tip is brought toward the pertinent notch 7, and the free corner part of the lid sheet 6 adjacent the pertinent slit 8 is lifted by the finger tip. This part of the lid sheet 6 is thus pulled away from the main structure 5 as shown in FIG. 3 thereby to tear off this part of the lid sheet 6 along substantially the centerline of the nearest connective rim flange 2, the uniaxial characteristic of the lid sheet 6 being utilized. As a result, the compartment is unsealed and opened as shown in FIG. 4.

Figure 5:
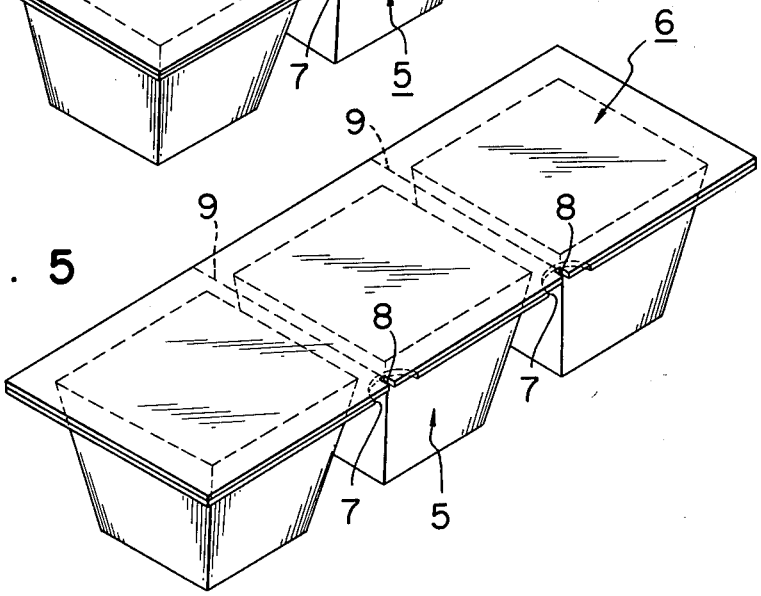
FIG. 5 is a perspective view of a modification of the example container illustrated in FIGS. 1 through 4.

While, in the above described embodiment of this invention, a uniaxially-stretched polyethylene film is used for the lid sheet 6, it is possible to use for this sheet materials such as another synthetic resin film or a paper material which tears more easily in one direction. Furthermore, when a material having no directivity is used, lines of perforations or the like 9, shown in FIG. 5, for facilitating tearing along intended lines may be formed in the front-to-rear direction in the lid sheet 6 along paths joining the slits 8 and coinciding with the centerlines of the rim flanges 2 of the main structure 5.

The material of the container main structure 5 is not limited to a synthetic resin, it being possible to use, according to necessity, other materials such as papers coated with wax, aluminum foil, and papers formed by suitably laminating materials such as synthetic resin and aluminum foil. Furthermore, in the case where a synthetic resin material is used, the main structure 5 may be formed by any suitable process such as blow molding or injection molding.

Because of the construction of the container of this invention as described above, wherein the container main structure comprises a plurality of mutually independent receptacles arranged in a row, it can be covered and sealed simply by a lid sheet to form mutually independent compartments. Furthermore, because of the provision of notches in specific positions in the edge flange of the container main structure and slits cut in the corresponding edge parts of the lid sheed, any one of the compartments thus sealed can be unsealed and opened by tearing off the corresponding lid sheet part from the nearest slit while leaving the other compartments as they are. Thus, a necessary quantity of the product can be unsealed and used.

Figure 6:
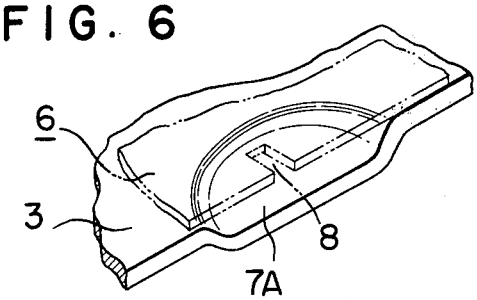
FIG. 6 is an enlarged, fragmentary, perspective and edge view showing a joggled depressed edge part which may be used in place of each notch.

In a modification of the above described example of the container of the invention, outer rim flange rigidifying joggled depressions 7A as illustrated in FIG. 6A is used in place of the notches 7. In all other respects, this modified example is the same as the preceding example.

Figure 7:
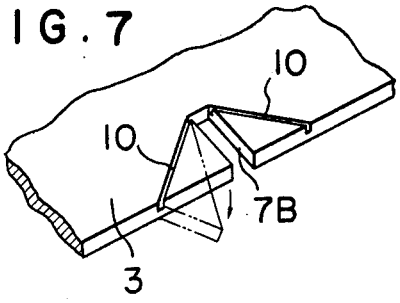

In another modification shown in FIG. 7, a slit 7B is formed in the rim flange 3, and a pair of score lines 10 are provided between the inner end of the slit 7B and the longitudinal edge of the flange 3, whereby by pushing down the triangular rim portion defined by the slit and the score line as indicated by chain line, the unsealing and opening by tearing off the corresponding lid sheet part are facilitated.

Figure 8:
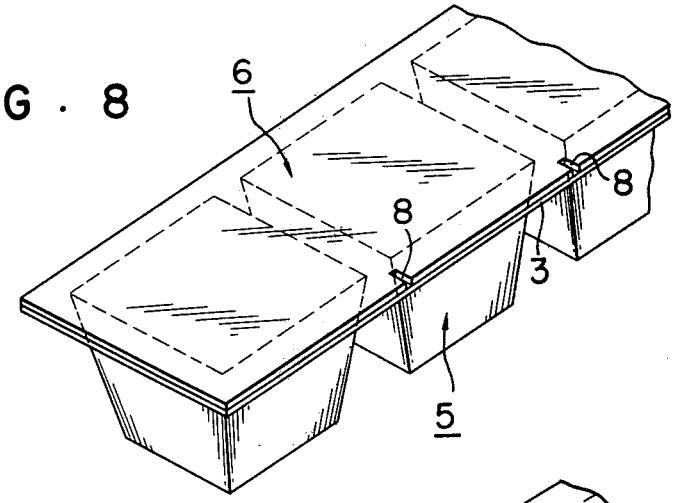

In a further modification of the above described example, neither of the longitudinal rim flanges 3 is provided with notches 7, joggled depressions 7A or slit 7B, as shown in FIG. 8. Instead, the lower surface of the lid sheet 6 is left unattached to the container main structure in the areas in the vicinity of the slits 8. This can be realized, for example, by interposing a small piece of sheet of unattachable nature between the sheet 6 and the rim flange 3 in each of the area. This unattached state of the lid sheet 6 in the area near the slits 8 facilitates the grasping of a free corner of a desired part of the lid sheet 6 in order to pull the same upward even without a notch 7, a joggled depression 7A or a slit 7B.

Figure 9:
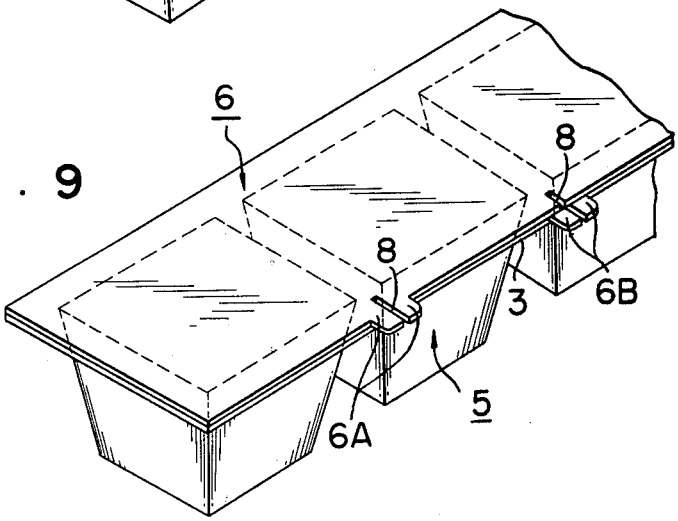

In a still further modification, shown in FIG. 9, of the construction of the container in the edge areas at the juncture between adjacent compartments, the lid sheet 6 is provided with two outwardly projecting tabs 6A lying side-by-side at each juncture, each tab **6*a* being integrally formed with the free corner of that portion of the lid sheet covering a corresponding compartment and projecting outward beyond the edge of the rim flange 3. Alternatively two separate tabs 6B may be interposed between the lid sheet 6 and the longitudinal and trnasverse rim flanges at each juncture, each tab being thus interposed under the corner of that portion of the lid sheet covering a corresponding compartment. In either case, when a tab is lifted, the corresponding corner of that portion of the lid sheet 6** is lifted and assumes a state wherein it can be easily grasped and lifted further to tear off that portion of the lid sheet thereby to unseal and open the corresponding one compartment.

While the container of the above description according to this invention has ample utility as it is for packaging or otherwise containing certain products sealed in mutually independent compartments, this container is most advantageously used in a state wherein it is further accommodated within and in combination with some outer housing structure such as an outer box.

One example of such an outer box will now be described with reference to FIGS. 10 through 18. In the outer box 24 shown as a development plan view in FIG. 10, the box can be assembled from a single integral blank of sheet material. This blank comprises a lid front flap 11, an upper lid wall 12, a rear wall 13, a bottom wall 14, a front wall 15, side walls 16, rear end flaps 17, bottom end flaps 18, and front end flaps **17*a***, which are interconnected as shown along fold lines. These walls and flaps are of their respective shapes as shown in FIG.

10 and of respective dimensions such that when the blank 24 is folded to form the outer box, the interior space of this outer box will be suitable for accommodating and being used in conjunction with the aforedescribed container as described hereinafter.

The lid front flap 11 is provided at its middle part with a projecting tab 19 formed by cutting therein a slit extending continuously along its upper part and two sides. The front wall 15 is provided at its middle part with a slit 20 for receiving and retaining the projecting tab 19 of the lid front flap 11 when the upper lid wall 12 and the lid front flap 11 has been once opened as described hereinafter. The front wall 15 is further provided at the outer edge thereof with cutouts 21 which are mutually spaced apart and are disposed symmetrically on the opposite sides of the slit 20 at positions to coincide with respective notches 7 when the outer box 24 is assembled to package a sealed container comprising the container main structure 5 and the lid sheet 6.

The lid front flap 11 is provided along its central portion horizontally from one side to the other, except for a marginal part at both sides, with a tearable "zipper" strip 22 formed and defined by a line of perforations, which joins the two ends of the slit forming the projecting tab 19. Furthermore, two perforation lines 23 joined to and starting from the ends of the "zipper" strip 22 extend (downwardly as viewed in FIG. 10) across the upper lid wall 12 parallelly to and spaced apart from their respectively nearest fold lines between the upper lid wall 12 and the side walls 16, terminating at the fold line between the upper lid wall 12 and the rear wall 13.

Figure 11:
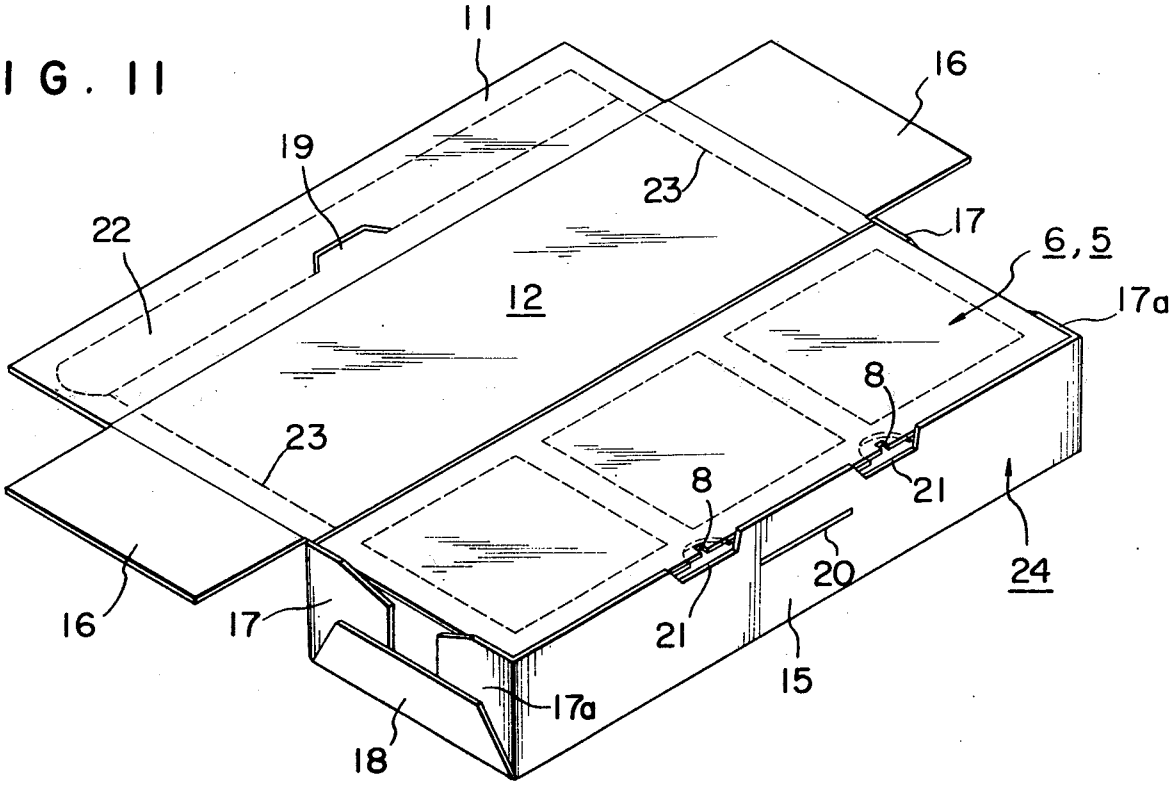
Figure 12:
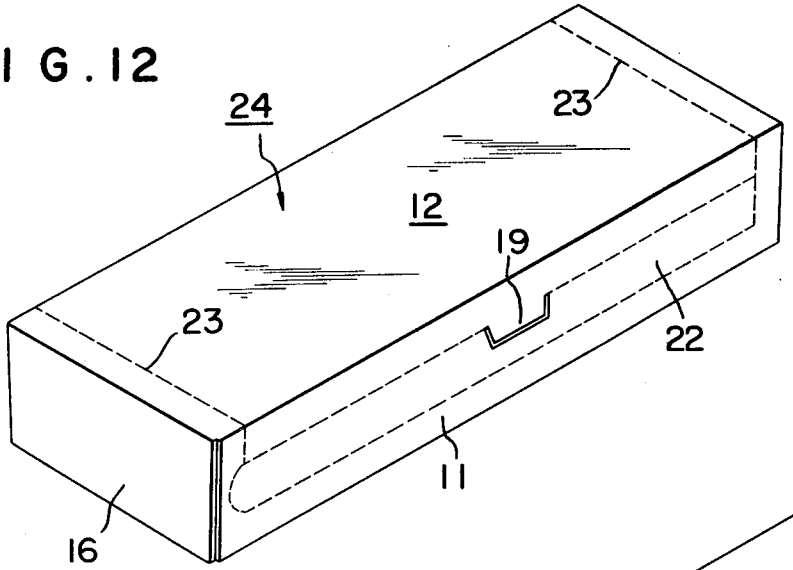

In packaging the aforedescribed container 5 containing a specific product and covered and sealed by the lid sheet 6 within the outer box, this container 5 is placed in coinciding alinement on the bottom wall 14 of the outer box blank 24, and the peripheral rear and front walls 13 and 15 and the rear end, front end, and bottom end flaps 17, 17*a*, and 18 are raised by bending along the appropriate fold lines as shown in FIG. 11. Next, the upper lid wall 12 and the lid front flap 11 are bent inward along their fold lines, and the outer horizontal edge part of the lid front flap 11 is adhesive bonded to the bottom portion of the outer wall surface of the front wall in a manner such that no adhesive is applied to the "zipper" strip 22. Then the inner surface of each side wall 16 is adhesive bonded to the rear and bottom end flaps 17 and 18, whereupon the assembly of the entire package is completed as shown in FIG. 12.

Figure 13:
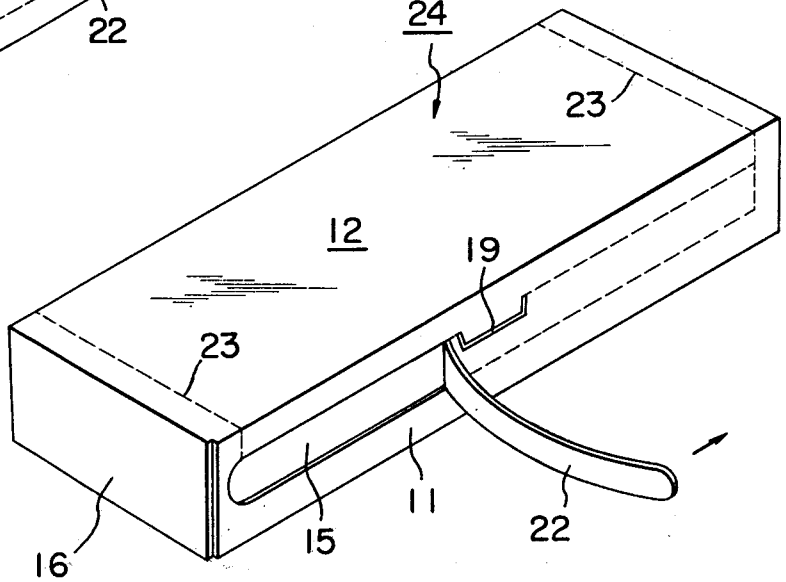
Figure 14:
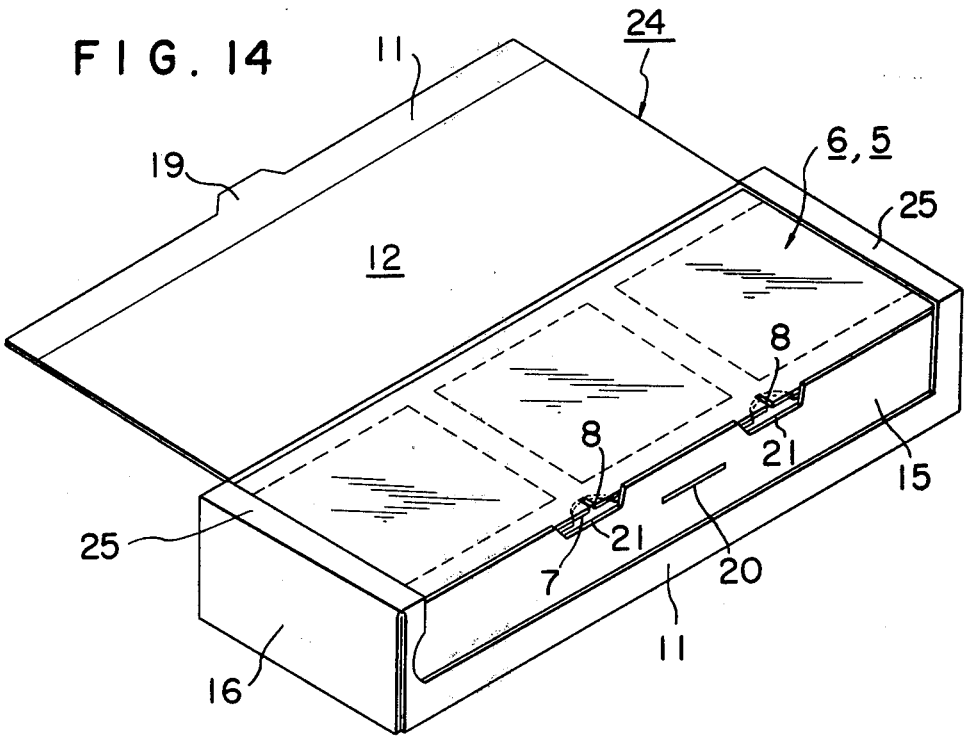

When this package is to be unsealed and used, the "zipper" strip 22 is first torn away as indicated in FIG. 13. This leaves the upper part of the lid front flap 11 in a free and openable state. This upper part of the lid front flap 11, including the projecting tab 19, is then raised, together with the upper lid wall 12 between the side perforation lines 23, thereby tearing the side end portions of the front flap 11 and the lid wall 12 along these side perforation lines 23. When the lid wall 12 is thus fully torn away from the side end portions 25 thereof, the opened outer box 24 is in the state illustrated in FIG. 14.

The side end portions 25 thus left as a part of the vessel structure of the outer box 24 constitute retaining flanges, by which the container main structure 5 is held at its side ends and prevented from easily slipping out of the outer box 24.

Then the lid sheet 6 of the container at its portion covering a compartment which is to be opened is opened by lifting its free corner at the slit 8 and further tearing the lid sheet portion away from the container main structure 5. Thus, only one compartment can be unsealed and opened for extraction of the product contained therein without unsealing the remaining compartments, as shown in FIGS. 15 and 16.

The upper lid wall 12 and the upper part of the lid front flap 11 with the projecting tab 19 can be closed with the container and outer box 24 in the above described condition. In this case, the projecting tab 19 is fitted into the slit 20 in the front wall 15, whereby the outer box 24 housing the container 5 is placed in a neatly closed state as shown in FIG. 17.

In a modification of the above described example of the outer box 24 according of the invention, the simple slit 20 in the front wall 15 for receiving and retaining the projecting tab 19 of the lid front flap 11 is replaced by a cutout 20*b* and two slits 20*a* communicating with the cutout 20*b* in the front wall 11 as shown in FIG. 18A. The slits 20*a* are made arcuate in plan shape, and the inner edge of the cutout 20*b* is also made arcuate to form a smooth arcuate curve with the slits 20*a*, whereby a tab-like part 20*c* is formed on the front wall 15. When this tab-like part 20*c* is bent very slightly outward, it functions as a guide and facilitates the insertion of the projecting tab 19 of the lid front flap 11 into closed state as illustrated in FIG. 18B.

It will thus be seen that, while the container of this invention possesses ample utility as it is, it can be further protected by its combination with the outer box 24. Moreover, the advantageous feature of convenient unsealability of any selected compartment of a plurality of compartments without disturbing the other compartments is fully retained in the combination of the container and the enclosing outer box 24. Furthermore, the retaining flanges 25 at the side ends of the outer box hold the container main structure 5 in the outer box, thereby facilitating the unsealing of a selected compartment.

Another useful feature of the combination of the container and the outer box 24 is that the product in the still sealed compartments and left-over portions of the product in an unsealed compartment, if any, can be protected and stored by reclosing the lid wall 12 and the lid front flap 11 and retaining them in this reclosed state by the insertion of the projecting tab 19 in the slit 20 or a modified form thereof.

We claim:

1. A container comprising a container main structure having a plurality of hollow receptacles for containing portions of a product or products in a sealed state, adjacent receptacles being integrally connected at their adjacent rims by a common connective rim flange, other outer rims of the receptacles having outer rim flanges and a lid sheet sealingly attached to the connective rim flanges and the outer rim flanges thereby to seal the interiors of the receptacles and thereby to form individually sealed compartments, the lid sheet having at edge portions thereof tear-facilitating means each comprising a slit cut into the edge of the lid sheet at the position of each connective rim flange and thus forming two adjacent free corners of the lid sheet each of which can be pried and pulled upward to partially tear off the lid sheet, the lid sheet being not attached to the container main structure in the neighborhood of each slit, one of said outer rim flanges of the container main structure being formed at its outer edge with slits each at a position coinciding with one slit of the lid sheet and with a pair of slanted score lines connecting the inner end of each of said slits in said outer rim flange with the outer edges of the same at both sides of each slit, thereby to enable depression of a portin of the outer rim flanges defined by the slit and score line so as to facilitate the prying up of a selected free corner of the lid sheet for tearing off the sheet.

2. A container as claimed in claim 1 which is combined with and packaged in an outer box having a lid of flap type which can be easily opened to expose only portions of the lid sheet for partial tearing off thereof for unsealing and opening of selected compartments and extraction of portions of the product without dislodgement of the container out of the outer box, the lid being reclosable to further protect the container and the contained product.

3. A container comprising a container main structure having a plurality of hollow receptacles for containing portions of a product or products in sealed state, adjacent receptacles being integrally connected at their adjacent rims by a common connective rim flange, other outer rims of the receptacles having outer rim flanges, a lid sheet sealingly attached to the connective rim flanges and the outer rim flanges thereby to seal the interiors of the receptacles and thereby to form individually sealed compartments, and tear-facilitating means provided at edge parts of said lid sheet at positions coinciding with said connective rim flanges and each position including a slit cut into the edge of the lid sheet at each of said positions and thus forming two adjacent free corners of the lid sheet each of which can be pried and pulled upward to partially tear off the lid sheet, one of said outer rim flanges being formed at its outer edge with a plurality of mutually isolated outer rim flange rigidity joggled depressions each disposed at a said position coinciding with one slit and covering only the region of said two adjacent free corners of the lid sheet in such a manner that said one rim flange is separated from the lid sheet only in said region to facilitate prying up of a selected free corner of the lid sheet.

4. A container according to claim 3 wherein each of said plurality of mutually isolated joggled depressions is formed in the shape of a semi-circle.

* * * * *